US005513601A

United States Patent [19]

Benson

[11] Patent Number: 5,513,601

[45] Date of Patent: May 7, 1996

[54] AIRCRAFT ENGINE

[76] Inventor: Robert A. Benson, 930 Cropwell Rd., Cherry Hill, N.J. 08003

[21] Appl. No.: 203,933

[22] Filed: Mar. 1, 1994

[51] Int. Cl.[6] ..... F02B 75/22

[52] U.S. Cl. ..... 123/54.4; 123/54.7; 123/195 R

[58] Field of Search ..... 123/54.1, 54.2, 123/54.4, 54.7, 54.8, 195 R

[56] References Cited

U.S. PATENT DOCUMENTS

| | | | |
|---|---|---|---|
| 1,312,555 | 8/1919 | McCain | 123/54.8 |
| 1,394,870 | 10/1921 | Thomas | 123/54.1 |
| 1,461,700 | 7/1923 | Nichols | 244/59 |
| 1,553,854 | 9/1925 | Fornaca | 123/54.7 |
| 1,580,082 | 4/1926 | Ybarra | 123/54.7 |
| 1,743,173 | 1/1930 | Warner | 123/54.4 |
| 1,780,450 | 11/1930 | Velton | 416/120 |
| 1,957,221 | 5/1934 | McCray | 180/53.1 |
| 2,256,601 | 9/1941 | West | 74/15.63 |
| 2,310,220 | 2/1943 | Michelis | 123/54.2 |
| 2,350,377 | 6/1944 | Tjaarda | 123/54.2 |
| 2,381,596 | 8/1945 | Jensen | 244/60 |
| 2,442,917 | 6/1948 | Butterfield | 123/54.8 |
| 2,470,155 | 5/1949 | Forsyth | 244/60 |
| 2,705,002 | 3/1955 | Bosma | 123/195 A |
| 2,757,547 | 8/1956 | Julin | 74/131 |
| 4,114,586 | 9/1978 | Fujikawa et al. | 123/198 C |
| 4,129,043 | 12/1978 | Ishikawa | 74/219 |
| 4,398,684 | 8/1983 | Von Ruden | 244/54 |
| 4,841,789 | 6/1989 | Ochiai | 123/90.31 |
| 4,955,561 | 9/1990 | Seefluth | 244/60 |
| 5,172,786 | 12/1992 | Ishibashi et al. | 180/190 |

*Primary Examiner*—David A. Okonsky
*Attorney, Agent, or Firm*—Banner & Allegretti, Ltd.

[57] ABSTRACT

The invention relates to an engine for an aircraft. The engine includes an engine housing having a drive shaft and a power output shaft. The power output shaft and the drive shaft are separately journalled within the engine housing. The power output shaft includes a propeller at a front end for providing propulsive thrust for the aircraft. The aft end of the power output shaft extends aft of the engine housing. The drive shaft is rotatably coupled to the aft end of the power output shaft by a gear train located outside and aft of the engine housing. The engine provides bearings which solidly support the power output shaft over a substantial portion of its length. This arrangement significantly reduces the loads which would be applied to the drive shaft and other engine components, and therefore, increases the service life of these components.

5 Claims, 6 Drawing Sheets

AIRCRAFT ENGINE

FIELD OF THE INVENTION

This invention relates to an engine for propeller driven aircraft. More specifically, this invention relates to an engine arrangement having separate crank and power output shafts which are independently journalled within the engine housing to provide propulsive thrust for an aircraft.

BACKGROUND OF THE INVENTION

When propeller driven aircrafts, especially airplanes, take off or turn in flight, their propeller shaft is placed under extremely high loads. Forces from these loads are, desirably, partly absorbed by the propeller shaft and partly transferred to thrust and rotational bearings which support the propeller shaft. However, some of these forces are undesirably transferred to the gear train connecting the propeller shaft to the crankshaft, the crankshaft itself, and other engine parts, e.g., connecting rods, pistons, and crankshaft bearings and seals. If the propeller shaft is poorly balanced, the undesired transferred forces tend to be higher and more concentrated, and additional forces due to the instability of the propeller shaft may also be transferred to these components. Many of these components are not designed to accommodate such forces. Consequently, the effective life of these components is reduced and the servicing and replacement of these components must be done more frequently. Further, the failure of one of these components in flight or during take off may cause the plane to crash, possibly resulting in human injuries and deaths and significant property damage.

A prior art airplane engine and propeller drive arrangement 10 for an airplane 13 is schematically shown in FIG. 1. Arrangement 10 includes a combustion airplane engine 11, a crankshaft 14, a transfer case 20, and a propeller shaft 22 with a propeller 23 mounted at the forward end thereof. Engine 11 includes a crankcase 12, and crankshaft 14 is journalled therein by a plurality of bearings 16.

Transfer case 20 is mounted to the outside of front wall 18 of crankcase 12, either directly or by supports 21. Crankshaft 14 penetrates front wall 18 of crankcase 12 and extends into transfer case 20. Propeller shaft 22 is journalled in transfer case 20 by a plurality of supported bearings 24. Inside transfer case 20, a gear train 25, consisting of gears 26, 27, and 28, rotatably couples crankshaft 14 to propeller shaft 22. Rotational power transferred from crankshaft 14 to propeller shaft 22 with propeller 23 thereon provides propulsive thrust for airplane 13.

During flight, torsional and other forces are encountered by propeller 23 and propeller shaft 22 due to wind resistance and various other loads. These forces can be very significant, especially when the airplane is taking off or turning in flight. In this prior art arrangement 10, propeller shaft 22 is proportionally short and is journalled in transfer case 20 by bearings 24 which can only be spaced over a relatively short distance $d_1$. This limits the ability of propeller shaft 22 to absorb a large portion of these forces and reduces the ability to support and balance propeller shaft 22 by bearings spaced over a large distance. Consequently, these forces and forces resulting from any instability of propeller shaft 22 are undesirably transferred to gears 26, 27, and 28 in gear train 25, crankshaft 14 via gear train 25, and many other engine parts via crankshaft 14. These components are typically not designed to handle such forces. Therefore, arrangement 10 requires frequent servicing and replacement of parts. In addition, as previously mentioned, the failure of some of these components in flight or during take off could lead to catastrophic results.

Another drawback of this prior art arrangement is the transfer of large vibrational forces to the airplane body, and more specifically the airplane cabin, when the airplane is taking off or turning in flight.

Therefore, it would be advantageous to have an aircraft engine arrangement which enhances the balancing and support of the propeller shaft to reduce the loads on the bearings, gears, seals, crankshaft, and other engine components, thereby increasing the service life of these components.

SUMMARY OF THE INVENTION

It is an object of the invention to provide an aircraft engine that overcomes the aforementioned drawbacks.

It is another object of the invention to provide an aircraft propeller driving arrangement which includes a stabilized elongated propeller shaft permitting the propeller shaft to absorb higher torsional forces.

It is yet another object of the invention to provide an aircraft propeller driving arrangement which includes an elongated propeller shaft journalled within the engine crankcase and supported by bearings spaced along a substantial portion of the length of the propeller shaft.

It is a further object of the invention to provide an aircraft propeller driving arrangement which transfers rotational power from the crankshaft to the propeller shaft by a single gear train located adjacent the end of the propeller shaft opposite the propeller, to reduce the undesirable forces transferred from the propeller shaft to the gear train, and thus, enhancing the life of the gear train, the crankshaft, and many other engine components.

It is another object of the present invention to provide an aircraft propeller driving arrangement which reduces aircraft cabin vibrations.

It is yet another object of the invention to advantageously locate an elongated propeller shaft above the crankshaft and between the cylinder banks of the engine to permit the aforementioned objects to be achieved without increasing the size of the propeller driving arrangement.

These and other objects are achieved by the present invention which, according to one aspect, provides an engine for a propeller driven aircraft. The engine includes a casting having a forward wall and an aft wall, a drive shaft, a power output shaft with a propeller attached to the front end thereof, and a power coupling for transferring rotational power from said drive shaft to said power output shaft. The drive shaft is journalled within the casting and rotatable about an axis. The power output shaft extends through the forward wall of the casting and is journalled within the casting about an axis parallel to the axis of rotation of the drive shaft.

In a second aspect, the engine includes an engine housing, a drive shaft, a power output shaft, a motive arrangement, and a power coupling. The engine housing includes a forward wall and an aft wall. The drive shaft is journalled within the engine housing and is rotatable about an axis. The power output shaft includes a front end with a propeller functionally coupled thereto for providing propulsive thrust for an aircraft when rotated. The power output shaft is also journalled within the engine housing and is rotatable about an axis parallel to the axis of rotation of the drive shaft. The power output shaft extends aft of the aft wall of the engine housing. The motive arrangement rotates the drive shaft. The power coupling transfers rotational power from the drive shaft to the power output shaft.

In another aspect, the invention provides an engine for a propeller-driven aircraft. The engine includes an engine housing, a drive shaft, a motive arrangement, a power output shaft, a journalling arrangement, a power coupling, and a propeller. The engine housing includes a front wall and an aft wall. The drive shaft is journalled within the engine housing and is rotatable about an axis. The motive arrangement rotates the drive shaft. The power output shaft is journalled by the journalling arrangement about an axis parallel to the axis of rotation of the drive shaft. The journalling arrangement is structurally coupled to the engine housing between the forward wall and the aft wall of the engine housing. The power coupling is located outside of the engine housing and transfers rotational power from the drive shaft to the power output shaft. The propeller is functionally coupled to, and coaxial with, the front end of the power output shaft for providing propulsive thrust for the aircraft when rotated.

In yet another aspect, the invention provides an engine for a propeller-driven aircraft. The engine includes an engine housing, a drive shaft, a motive arrangement, a power output shaft, a power coupling, and a propeller. The engine housing includes a front wall and an aft wall. The drive shaft is journalled within the engine housing and is rotatable about an axis. The motive arrangement rotates the drive shaft. The power output shaft is also journalled aft of the front wall of the engine housing and is rotatable about an axis parallel to the axis of rotation of the drive shaft. The power coupling is external to the engine housing and transfers rotational power from the drive shaft to the power output shaft. The propeller is functionally coupled to the front end of the power output shaft for providing propulsive thrust for the aircraft when rotated.

DETAILED DESCRIPTION

Figure 1:
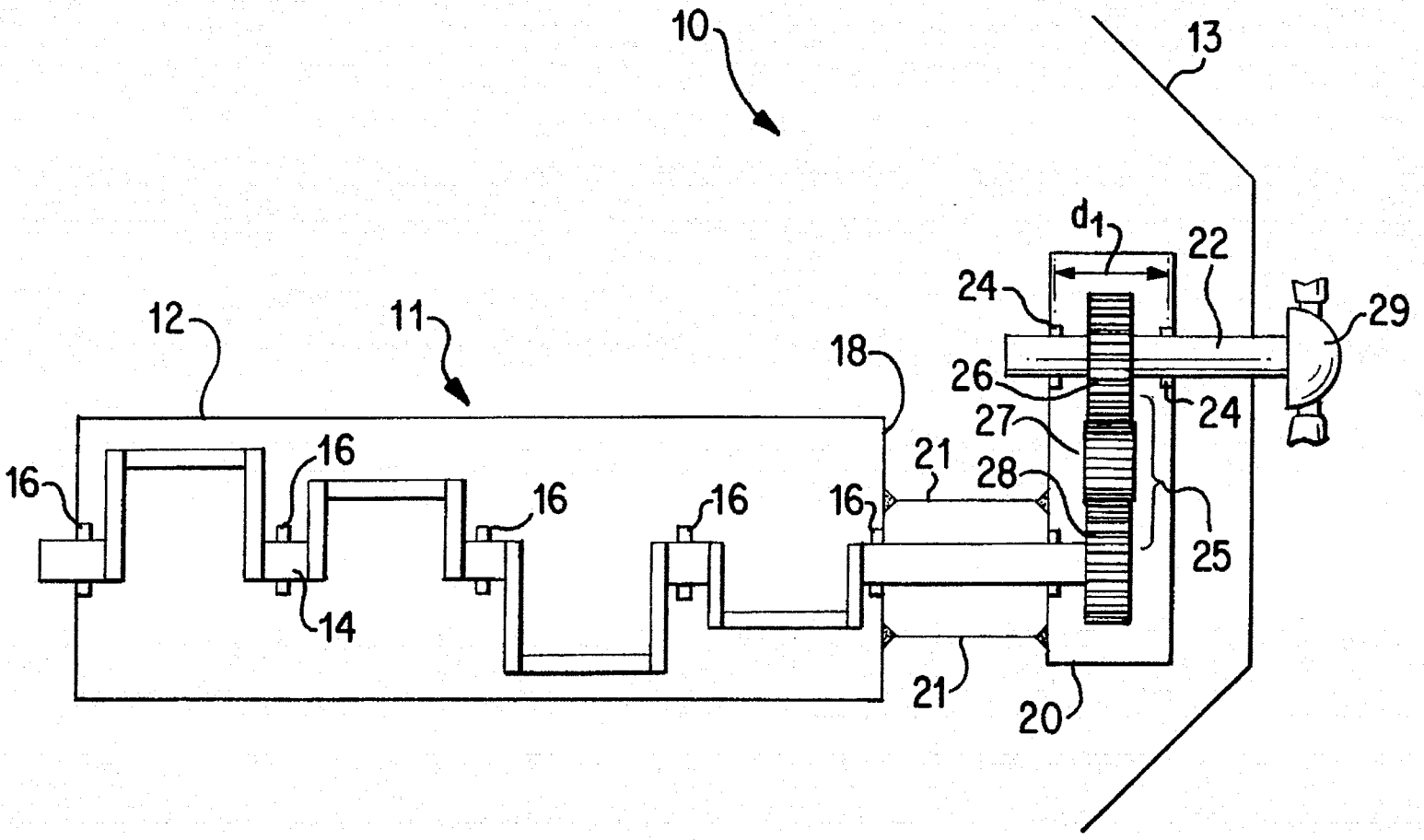
FIG. 1 PRIOR ART
FIG. 1 schematically depicts a side sectional view of a portion of a prior art aircraft which utilizes a crankshaft journalled inside an engine, and a propeller shaft, separate from the crankshaft, which is journalled inside a front-mounted transfer case.

Referring to FIGS. 2–6, an aircraft engine in accordance with the present invention is generally indicated by reference numeral 30. As engine 30 is shown as being of the internal combustion type, the description of some of its components may be specific to internal combustion engines. However, one skilled in the art would recognize that certain teachings of this invention are also applicable to turboprop engines, which would likely include a pusher propeller.

It should also be recognized that certain terms defined herein are generic to both internal combustion and turboprop engines. For example, the term "drive shaft" as used herein refers to the shaft which is rotatably coupled to pistons in an internal combustion engine (i.e., the crankshaft) or which is directly turbine-driven in a turboprop engine (i.e., the turbine shaft). Further, the term "engine housing" is used herein to designate the structural housing member or members which enclose the drive shaft. Therefore, the engine housing is a crankcase in an internal combustion engine and is a turbine housing in a turboprop engine.

Engine 30 includes a crankcase 31 with a propeller shaft 32 and a crankshaft 34 independently journalled therein. Engine 30 is oriented with respect to an aircraft, not shown, so that crankshaft 34 and propeller shaft 32 are each supported for rotation about axes that are parallel to the fore-aft axis of the aircraft body. Propeller shaft 32 has a propeller, schematically represented by reference numeral 36, mounted at the forward end thereof to provide propulsive thrust for the aircraft when rotated. Further, as schematically illustrated in the drawing figures, it is apparent that propeller shaft 32 may be a solid cylindrical bar.

Figure 5:
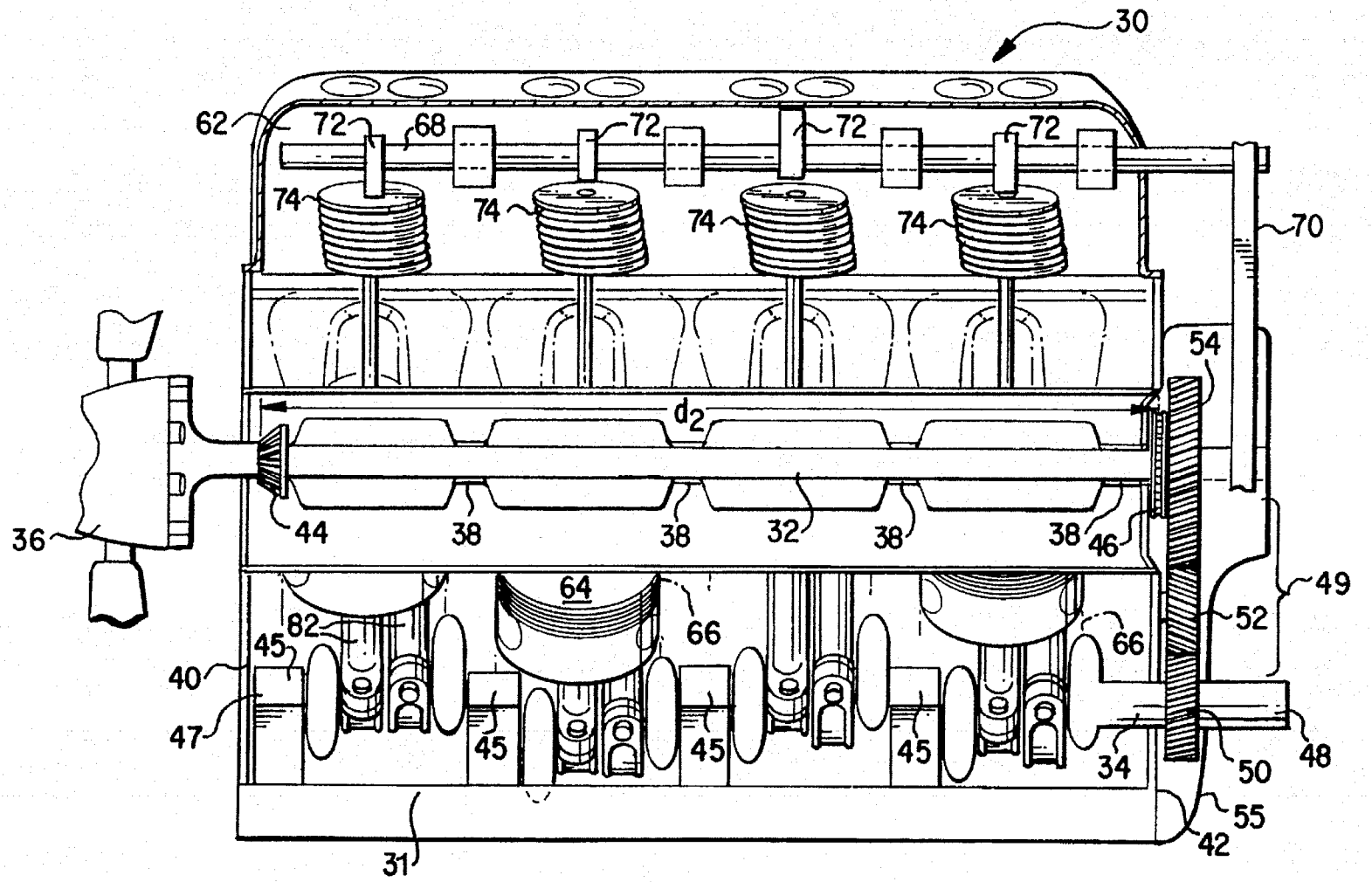
FIG. 5 is a cross-sectional view of the aircraft engine taken along line 5—5 of FIG. 4.

As depicted in FIG. 5, propeller shaft 32 extends aft of propeller 36, through both the front wall 40 and the aft wall 42 of crankcase 31, and terminates aft of aft wall 42. Propeller shaft 32 is journalled within crankcase 31 by a plurality of radial bearings 38. A front thrust bearing 44 and an aft thrust bearing 46 are located adjacent front wall 40 and aft wall 42 of crankcase 31, respectively, to rotatably support and absorb linear thrust applied to propeller shaft 32. Bearings 38, 44, and 46 rotatably support and balance propeller shaft 32 over distance $d_2$, which is substantially the distance between fore and aft walls 40 and 42 and which is a substantial portion of the length of propeller shaft 32. As compared to the prior art (e.g., FIG. 1), propeller shaft 32 is better balanced and supported, and the undesirable forces that are transferred to crankshaft 34 will be smaller.

Crankshaft 34 is located below, and in the same vertical plane as, propeller shaft 32. A plurality of radial bearings 45 rotatably support crankshaft 34 inside crankcase 31. Crankshaft 34 includes a forward end 47 which is located inside crankcase 31. Crankshaft 32 extends aft of forward end 47, through aft wall 42 of crankcase 31, and terminates at an aft end 48 which is aft of aft wall 42.

Figure 4:
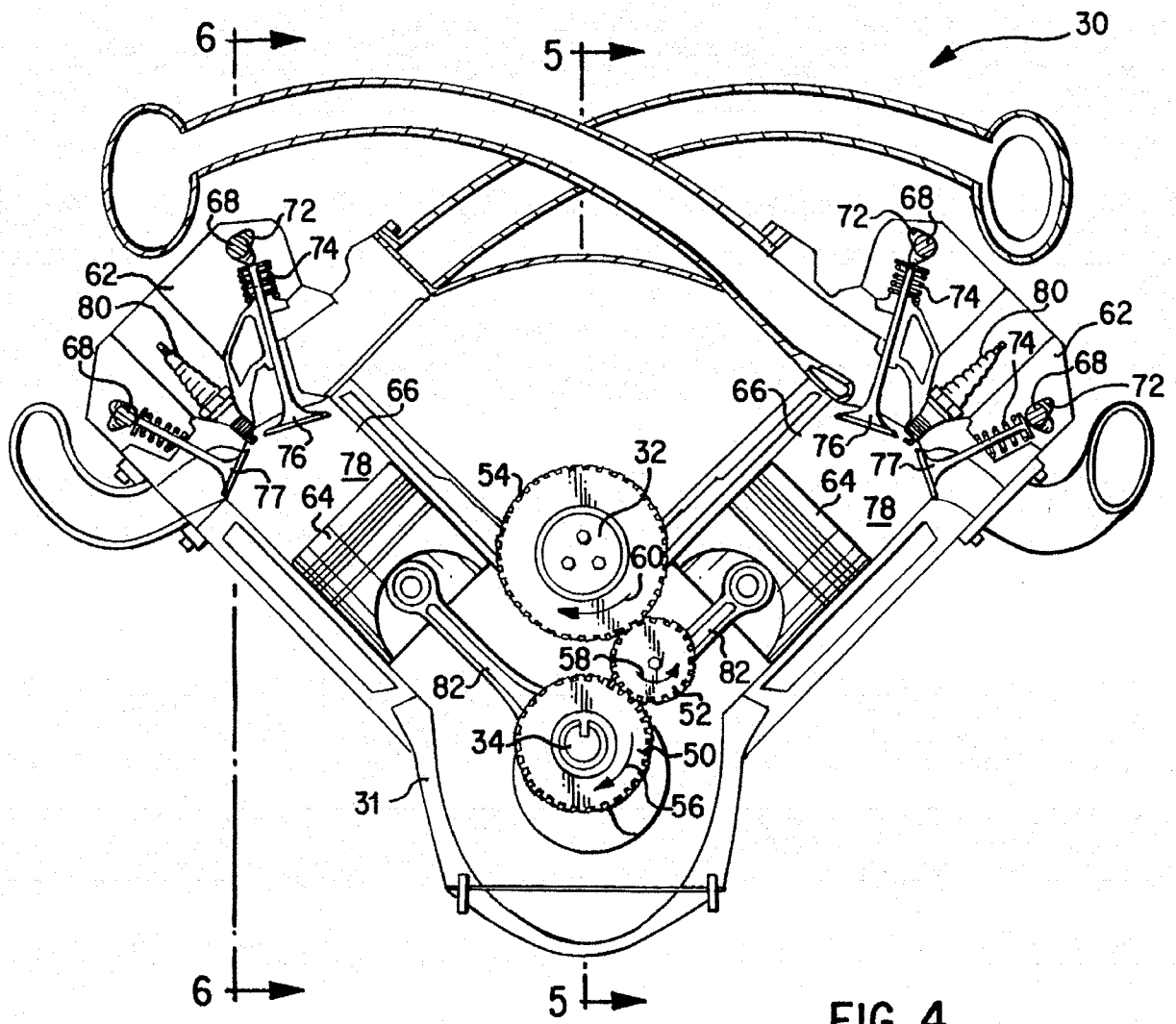
FIG. 4 is a cross-sectional view of the aircraft engine taken along line 4—4 of FIG. 2.
Figure 6:
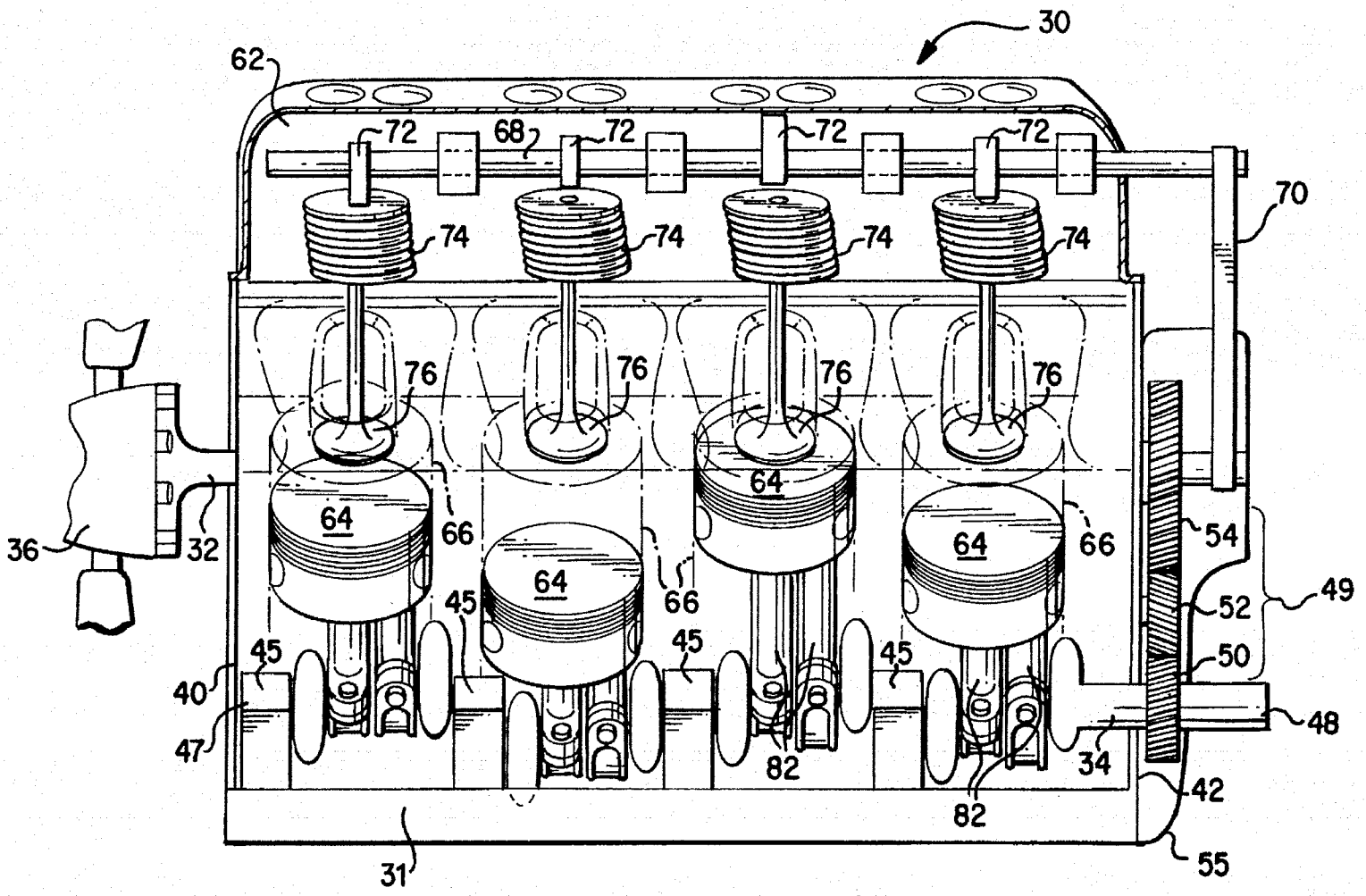
FIG. 6 is a cross-sectional view of the aircraft engine taken along line 6—6 of FIG. 4.

As illustrated in FIGS. 4–6, the portions of crankshaft 32 and propeller shaft 34 located aft of aft wall 42 are rotatably coupled to each other permitting the transfer of rotational movement from crankshaft 32 to propeller shaft 34. The coupling consists of a gear train 49 which includes a crank gear 50 fixedly mounted on crankshaft 34, an idler gear 52, and a power output gear 54 fixedly mounted on propeller shaft 32. A protective access cover 55 may be bolted or otherwise attached to aft wall 42 of crankcase 31 to protect gear train 49.

As shown in FIG. 4, clockwise rotation 56 of crank gear 50, causes counter-clockwise rotation 58 of idler gear 52, which in turn, causes clockwise rotation 60 of power output gear 54. Thus, crankshaft 34 and propeller shaft 32 always rotate in the same direction. While the power coupling is preferably a gear train, the transfer of rotational power from crankshaft 34 to propeller shaft 32 could also be achieved by a gear and chain arrangement.

Figure 2:
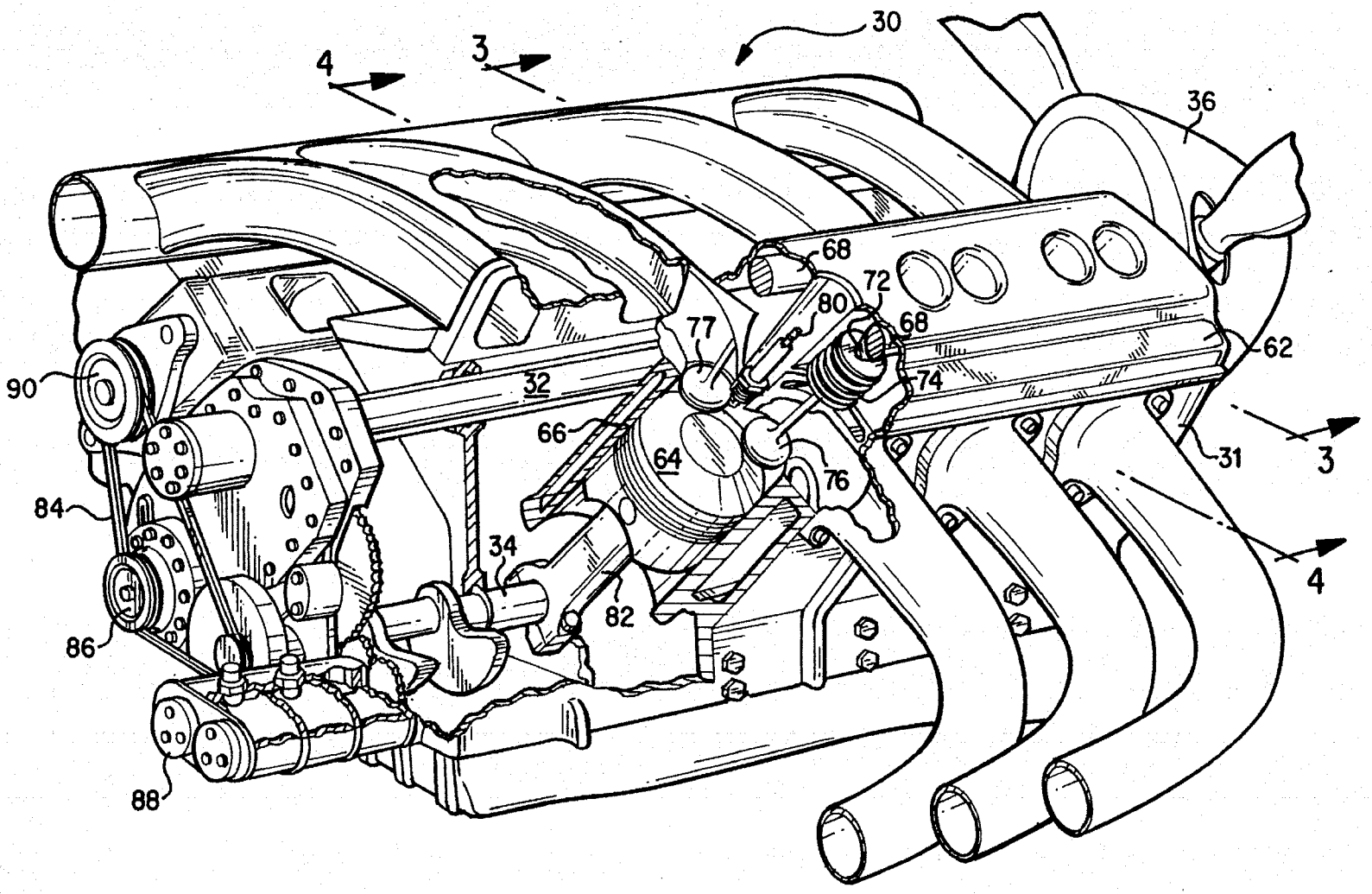
FIG. 2 is an isometric view of the aircraft engine of the present invention with portions thereof cut away to expose certain interior areas of the engine.
Figure 3:
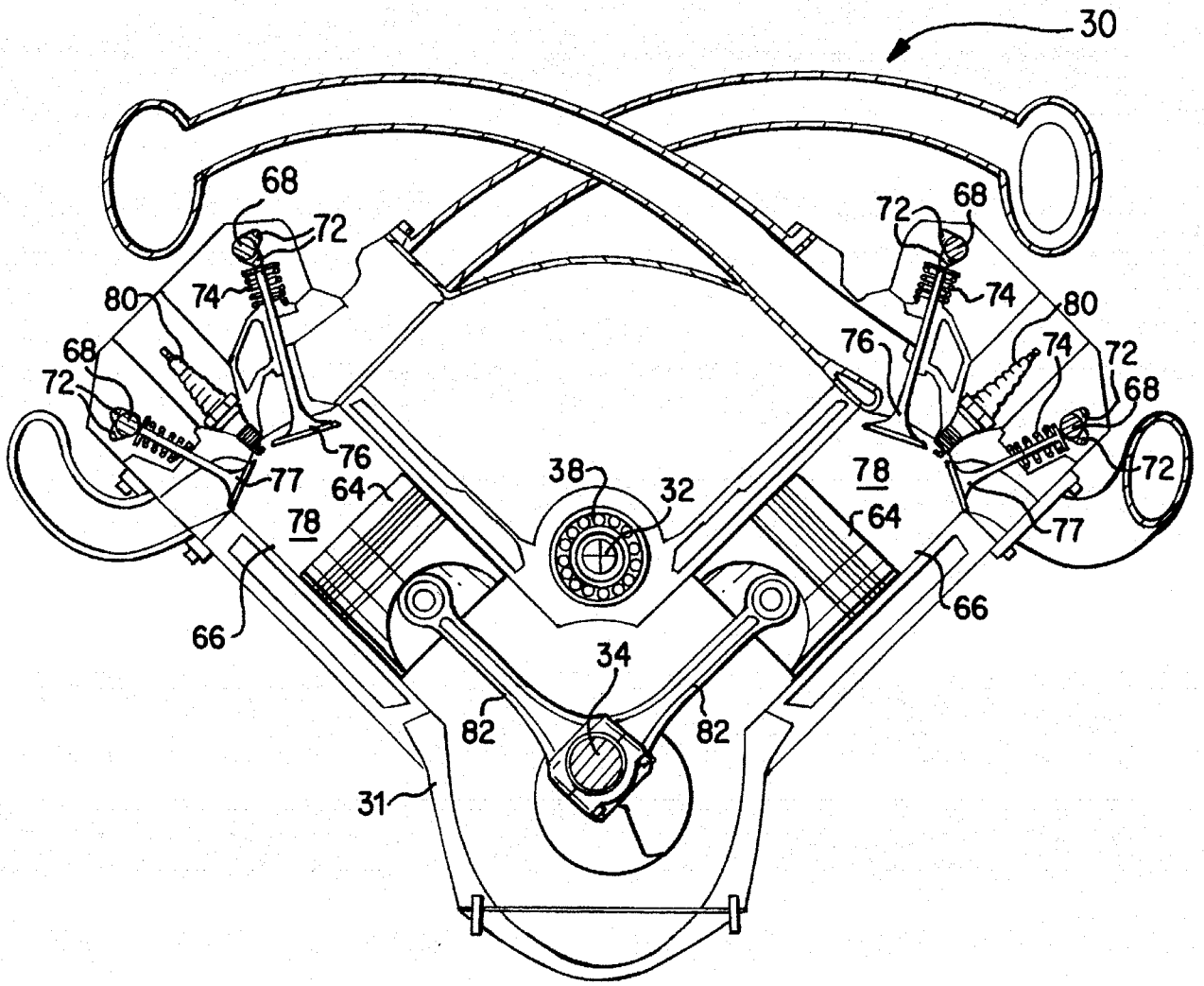
FIG. 3 is a cross-sectional view of the aircraft engine taken along line 3—3 of FIG. 2.

Engine 30 is an internal combustion engine. As depicted in FIGS. 2–4, engine 30 preferably includes two banks 62 of four pistons 64 and cylinders 66 forming a V-8 configuration. Pistons 64 reciprocate within cylinders 66 in accordance with typical four-stroke (Otto cycle) engine principles, i.e., utilizing induction, compression, power and exhaust strokes.

Two camshafts 68 per cylinder bank 62 are parallel to crankshaft 34 and propeller shaft 32 and are journalled in the head of their respective cylinder bank 62. Each pair of camshafts 68 in cylinder bank 62 is rotatably coupled to propeller shaft 32 by a single timing belt 70.

In a manner well known in the art, the rotation of camshafts 68 with cams 72 thereon, downwardly displaces intake and exhaust valves 76 and 77, which are normally biased closed by valve springs 74. The downward displacement of intake valves 76 permits the admission of a fuel-air mixture into upper portion 78 of cylinders 66 during induction strokes. The downward displacement of exhaust valves 77 permits the exhaustion of combustion gases from upper portion 78 of cylinders 66 during exhaust strokes.

During power strokes, a spark plug 80 in each cylinder emits an electric spark causing the fuel in upper portion 78 of cylinder 66 to ignite, subsequently forcing the downward movement of piston 64. A connecting rod 82 is journalled at one end to a piston 64 and to the crankshaft 34 at the other end. Connecting rods 82 convert the linear reciprocating movement of pistons 64 into rotational movement of crankshaft 34. Rotational movement of crankshaft 34 is transferred, via gear train 49, into the rotational movement of propeller shaft 32 with propeller thereon 36 to provide propulsive thrust for the aircraft.

As shown in FIG. 2, aft end 48 of crankshaft 34 may also be coupled, via a chain or belt 84, to provide power for other aircraft accessories, e.g., external water pump 86, oil pump 88, or alternators 90. These accessories 86, 88, and 90 may alternatively be coupled to propeller shaft 32 in lieu of crankshaft 34.

The arrangement of separately journalled shafts 32 and 34 within crankcase 31 and the location of gear train 49 with respect to crankcase 31, yields several advantages. These include longer service life, lower failure rates, and less frequent repair and replacement of gears 50, 52, 54, crankshaft 34, propeller shaft 32, and other engine parts.

These benefits are achieved in part because propeller shaft 32 has an extended length which is longer than crankshaft 34 and which allows it to be more solidly supported by bearings 38, 44 and 46 spaced over a substantial portion of its length. Also, the extended length of propeller shaft 32 permits it to absorb higher torsional forces, thus transferring less undesired force to gear train 49 and crankshaft 34. In addition, the location of gear train 49 aft of crankcase aft wall 42 reduces the transfer of undesired forces from propeller shaft 32 to gears 50, 52, and 54, crankshaft 34, and other engine components because it is more isolated from propeller 38 and the forces applied thereto. This permits a smoother transfer of power, enhances the life of the gears, and also reduces cabin vibrations.

While the preferred embodiment is depicted in FIGS. 2–6, it should be recognized that other types of engines could be utilized without departing from the scope of the invention. For example, while engine 30 includes eight cylinders 66, fewer or more than eight cylinders could be used. Additionally, while there are two camshafts 68 in each bank 62 of cylinders 66, the engine could be configured to include one camshaft for each cylinder bank. Further, while timing belts 70 are shown as rotatably coupling camshafts 68 to propeller shaft 32, the timing belt could rotatably couple the camshafts to the crankshaft instead of the propeller shaft. Also, while timing belt 70 is utilized to rotatably couple camshafts 68 to propeller shaft 32 (or crankshaft 34), a chain or gearing arrangement can be used in lieu of a timing belt.

In addition, while the preferred embodiment is a four-stroke internal combustion engine, a two-stroke engine or a rotary piston engine, i.e., a Wankel engine, could be used to impart rotation to the crankshaft. Further, it should also be recognized that other types of four-stroke engines, e.g., in-line or horizontally opposed, could be used in lieu of the V-type engine.

It is to be understood that the disclosed embodiments are merely illustrative of the principles of the present invention which could be implemented by other types of structures which would be readily apparent to those skilled in the art. For example, while the illustrated embodiments depict a tractor propeller, one skilled in the art would recognize that the engine could be reversed and include a pusher propeller in lieu of a tractor propeller. Accordingly, the scope of the present invention is to be determined in accordance with the appended claims.

We claim:

1. An internal combustion engine for use with a propeller-driven aircraft, the engine comprising:

an engine housing having a front wall and an aft wall;

a drive shaft journalled within the engine housing and rotatable about an axis, said drive shaft extending through said aft wall of said engine housing and aft of said aft wall of the engine housing, said drive shaft having a forward end located within said engine housing between the front wall and the aft wall of the engine housing;

motive means for rotating said drive shaft, said motive means includes two cylinder banks in a V-type configuration;

a power output shaft having a front end with a propeller attached thereto, said power output shaft journalled within the engine housing and rotatable about an axis parallel to the axis of rotation of the drive shaft, and said power output shaft extending through both said forward wall and said aft wall of the engine housing and aft of said aft wall of the engine housing, said power output shaft being located vertically above the drive shaft and horizontally between said two cylinder banks such that the rotational axis of said drive shaft and the rotational axis of said power output shaft lie in the same vertical plane;

a power coupling for transferring rotational power from said drive shaft to said power output shaft, said power coupling located outside of the engine housing proximate said aft wall of the engine housing, said power coupling includes a first gear attached to said drive shaft, a second gear attached to said power output shaft, and at least one idler gear for converting rotational power from said first gear to said second gear; and a camshaft, said camshaft being coupled to one of said drive shaft and said power output shaft by a coupling means for rotating the camshaft at a velocity which is proportional to a rotational velocity of said one of said drive shaft and said power output shaft, said camshaft coupling means located outside of the engine housing proximate said aft wall of the engine housing; and said propeller providing propulsive thrust for the aircraft when rotated.

2. The engine as set forth in claim 1, wherein said one of said drive shaft and said power output shaft is the power output shaft.

3. The engine as set forth in claim 1, wherein said power output shaft is a solid cylindrical bar.

4. The engine as set forth in claim 1, wherein said drive shaft and said power output shaft include rear ends, said first gear is attached to the drive shaft adjacent the rear end of the drive shaft, and said second gear is attached to the power output shaft adjacent the rear end of the power output shaft.

5. The engine as set forth in claim 1, wherein said power output shaft and said camshaft include rear ends, said camshaft coupling means coupling said camshaft and said power output shaft adjacent their rear ends.

* * * * *